United States Patent [19]

Mo

[11] 3,961,489

[45] June 8, 1976

[54] METHOD FOR PLACING A FLOATING STRUCTURE ON THE SEA BED

[76] Inventor: Olav Mo, Gronsundveien 94, Nesbru, 1370 Asker, Norway

[22] Filed: Oct. 18, 1974

[21] Appl. No.: 516,123

Related U.S. Application Data

[62] Division of Ser. No. 352,679, April 19, 1973, Pat. No. 3,911,687.

[30] Foreign Application Priority Data

May 2, 1972 Norway ..... 1541/70

[52] U.S. Cl. ..... 61/46.5; 61/50

[51] Int. Cl.[2] ..... E02B 17/00

[58] Field of Search ..... 61/46.5, 46, 50

[56] References Cited

UNITED STATES PATENTS

| | | | |
|---|---|---|---|
| 2,895,301 | 7/1959 | Casagrande et al. | 61/46.5 |
| 3,246,476 | 4/1966 | Wolff | 61/46.5 |
| 3,277,653 | 10/1966 | Foster | 61/465 |
| 3,738,113 | 6/1973 | Madary et al. | 61/46.5 |

FOREIGN PATENTS OR APPLICATIONS

| | | | |
|---|---|---|---|
| 1,088,804 | 10/1967 | United Kingdom | 61/46.5 |

*Primary Examiner*—Jacob Shapiro
*Attorney, Agent, or Firm*—Larson, Taylor and Hinds

[57] ABSTRACT

A method of supporting a structure, such as a drilling structure used in offshore oil activities. The structure includes a caisson having at least one ballast cell and a plurality of skirts extending downwardly below the base of the caisson. The skirts define compartments which are open at their lower ends. The structure is floated to a location at sea and is then sunk. Ballast is then introduced into the ballast cell to cause the skirts to penetrate downwardly into deeper layers of sea bed soil. The skirts thus form closed compartments. Sea water trapped within the compartments is then removed and ballast is then removed from the ballast cell to reduce the vertical load on the sea bed to a load level such that the sea bed material does not fail. Movement of the structure is primarily restrained by adherence and friction between the sea bed and the skirts and by temporary pressure differentials within the closed compartments created by partial movement of the structure.

2 Claims, 3 Drawing Figures

METHOD FOR PLACING A FLOATING STRUCTURE ON THE SEA BED

This is a division of my copending application Ser. No. 352,679 filed Apr. 19, 1973 now U.S. Pat. No. 3,911,687.

The present invention relates in general to a method of supporting a floating body, such as for example a drilling and/or production platform, which is designed to rest on the sea bed at the operation site. Although not limited thereto, the present invention relates particularly, but not exclusively, to a method for supporting a marine structure used in offshore oil activities. It is, however, also possible to use the method according to the present invention on structures designed for other offshore activities.

In order to support an offshore structure, a support which is able to resist the enormous forces and moments caused by wind, waves and tidal streams is required. To submerge a floating structure onto the sea bed and use it as a support for an offshore platform is previously described for example in the applicant's U.S. Pat. No. 3,824,795. Further, it has been suggested to submerge a floating structure on to the sea bed, using it as an oil reservoir. Such structures have, however, been designed to rest directly on the sea bed without using any particular supporting means, mainly because it was assumed that the weight of the structure together with additional ballast weights would ensure the position and stability of the structure.

To locate a floating structure on the sea bed without using any supporting means will in most cases be an impossible task. The most frequent reason is that the state of the sea bed soil is poor, but also with good sea bed conditions, foundations may be impossible if the applied moments and forces are large. Another case where conventional surface foundation is imperfect, is where the foundation results in large longtime settlement, for example where the sea bed consists of soft clay.

A conventional surface foundation which is exposed to horizontal forces and moments is in addition dependent upon a large dead weight to prevent sliding or capsizing. Sufficient dead weight may be difficult to achieve, inter alia because a submerged structure subjected to wave loads simultaneously with the other loads will be exposed to substantial upward forces, which will act against the dead weight. There is thus a limit for the vertical forces which a conventional surface foundation can withstand. Finally, there is a limit for the dead weight of the structure if the structure is going to be floated out. To fill sand ballast after the structure has been positioned on the site means extra costs. Besides, a large dead weight has the disadvantage that the longtime settlement becomes large, which may be particularly troublesome on soft ground.

One of the objects of the present invention is to find a way for providing a structure with a foundation in deeper earth stratums which is firm enough to absorb the applied forces and preferably so that the foundation can be combined with a pile effect, i.e., that stresses may be taken up by friction/adhesion or passive earth pressure.

With a construction according to the present invention, these problems will be substantially reduced. Because passive earth pressure, friction/adhesion forces as well as forces due to underpressure are mobilized, the dependency upon large vertical forces is reduced.

The invention involves the extension of for example the walls of the structure a significant distance below the bottom slab of the structure and to press/jet the walls down into the ground until the bottom slab preferably reaches the sea bed. In reality, the structure is in this case provided with a foundation at a depth corresponding to the lower edge of the extended wall (the skirt) and will in addition be stabilized by friction/adhesion along the walls as well as passive earth pressure acting on the extended walls. If the foundation is made large and deep enough these forces will be large enough to resist the applied forces and moments caused by wind, wave and tidal streams and thus the forces acting in the vertical direction may cancel each other out. In such a case the structure will "float" and the sea bed will mainly only be loaded with shear forces caused by the above mentioned external forces. The settlement caused by these forces will be reduced to a minimum, while the longtime settlement caused by the weight of the structure will be reduced to zero.

Another object of this invention is thus to find a way for providing a structure with a foundation in deeper earth stratums such that the foundation can resist the forces acting on the structure in horizontal direction while the vertical loads caused by the structure on the soil, is reduced to a minimum, or preferably completed balanced.

The present invention relates to floating structures composed of one or more cells and to a support projecting downwardly from the lower section of the structure, the support being formed as a plurality of skirts which are designed to penetrate down into the sea bed to form a support for the structure. Sufficient penetration forces for pressing the support down into the sea bed is provided at least by ballast added to the cell structure. According to the present invention the main object is obtained by removing ballast from the cell when the structure is founded in order to reduce the vertical load exerted by the structure on the sea bed to a load level which the sea bed can bear. The removal of ballast is not executed until the support has reached the designed penetration depth where the friction/adhesion in the vertical direction between the support and the sea bed is sufficient to safely found the structure even with a reduced weight.

A foundation method according to the present invention is particularly favourable in cases where the sea bed consists for example of soft clay or mud. It should be noted, however, that the foundation method also may be favourable on sites having different soil conditions.

The skirt according to the present invention must not be mistaken for the conventional cutting edges since the effect in practice is completly different. The conventional small cutting edge may have a certain value against erosive undermining and may likewise prevent sliding at the joint between the caisson and the ground, but is without any effect in confrontation with soil conditions at greater depths, and these are as a rule decisive. Although the present invention preferably is used in connection with skirt, it should be noted that the present invention also is feasible in connection with any conventional support if the support provides sufficient friction/adhesion forces at the joint between the sea bed and the support to hold the floating structure even with a reduced weight.

The above and other important objects and advantages of the invention may best be understood from the following detailed description, constituting a specification of the same, when considered in conjunction with the annexed drawings, wherein.

Figure 1:
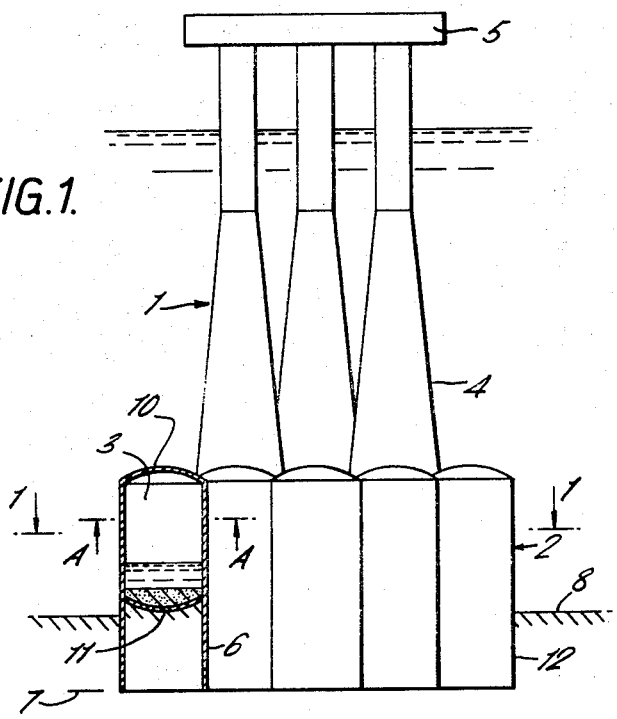
FIG. 1 shows a partly sectional sideview of a platform structure according to the present invention.

FIG. 1 shows a platform 1, for drilling and/or production of natural deposits, consisting of a caisson 2, resting on the sea bed 8. The caisson 2 consists of a number of vertical elongated cells 3. Three of the cells 3 are prolonged upwards, projecting above the sea level, forming a superstructure 4, which at its upper end supports a deck structure. At the lower end, the floating structure 2, is equipped with a downwardly extending and downwardly open support 12, the support being preferably formed of a number of skirts 6. These supports 12 are during the installation phase pressed down into the sea bed in order to support the structure stably. By using the skirts 6, the sliding surface moves down to the level 7 where the mobilized shear forces normally will be far larger than in the surface layer. In addition a passive earth pressure is achieved at the front edge and an active one at the rear edge which together provide a substantial resistive force. Also, frictional forces are obtained along the outer walls lying parallell to the direction of the force.

Another advantage of a structure according to the present invention and in comparison with conventional caissons is that friction/adhesion along the skirt wall leads to the tensile forces being absorbed by the support 12.

In dense soil tension may also be absorbed in the level 7 of the horizontal joint, since an upward movement will lead to an underpressure in this joint. The fact that tensile forces can be absorbed means great advantages, inter alia in that the resultant force will have less eccentricity for large overturning moments. The cells 3 are according to the present invention equipped with spherical upper and lower domes 10, 11.

By introducing a support formed for example of skirts 6 and by removing ballast partly or completely from the cells 3, the buoyancy of the platform will become equal to the dead weight of the platform. Thus, the vertical load on the sea bed will therefore almost become zero, except for small variations payload and uplift due to waves. However, these variations are small. The result is thus that the clay can easily absorbe the applied forces and movements without failing. Also, the longtime settlement will be very small.

The platform is lowered down onto the sea bed by pumping ballast into the cells 3, while the water, trapped in the room 9, formed between the skirt walls, the sea bed and the lower end of the caisson, is pumped out. Thus, the support will penetrate deep into the sea bed due to its weight and additional ballast weight to form a support for the platform. When the skirts are pressed sufficiently deep into the sea bed so that the structure is safely anchored to the sea bed, ballast is removed from the cells. According to the present invention so much ballast is removed that the buoyancy of the structure more or less is equal to its weight, or alternatively that the total weight of the structure is reduced to a level which the soil can bear without failing and without resulting in too large settlements.

It will immediately be understood that the embodiments of the invention as shown on the drawings and described above only are meant to illustrate the inventive thought and that this inventive thought may be varied in a series of ways within the scope of the invention. For example, it is not necessary to equip all the cells with a bottom slab and with a skirt.

Figure 2:
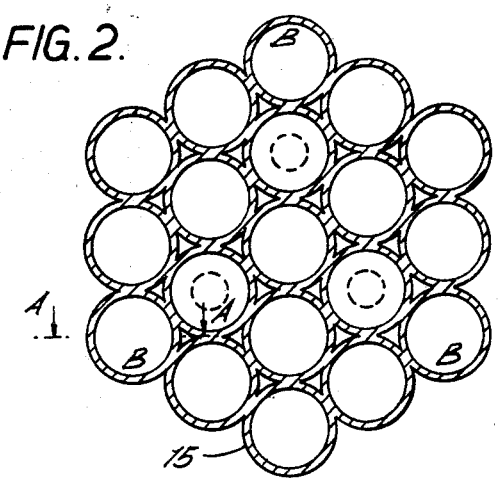
FIG. 2 shows a horizontal section through line 1—1 on FIG. 1.
Figure 3:
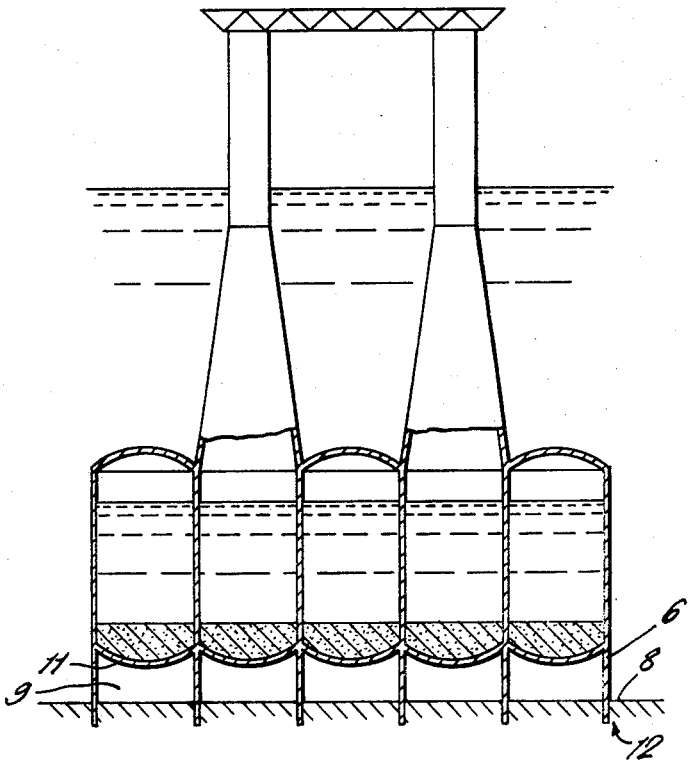
FIG. 3 shows a partly sectional vertical view of a structure according to the present invention.

It is possible to omit the bottom slab in some of the cells, preferably the cells which are equipped with skirts, whereby all forces more or less is absorbed as shear against the skirt walls. According to the example shown on FIG. 2, only the cells denoted with B is equipped with skirts.

The method according to the present invention is not dependent upon the number of skirts used, as long as the skirts or support used produce sufficient friction-/adhesion to hold the structure in designed position even after the ballast is partly or fully removed.

Even if it has in the foregoing been assumed that concrete is the construction material, it is evident that other materials, e.g. steel, may be used. Also, if concrete is used it may of course be reinforced or prestressed.

In order to render possible the method according to the present invention, the structure is fitted with a pipe and valve system (not shown) which enables ballast to be added or removed from the cells. This system can be of any conventional type, and the system will thus not be described in detail.

It will immediately be understood that the embodiments of the invention as shown on the drawings and described above only are meant to illustrate the inventive thought, and that this inventive thought may be varied in a series of ways within the scope of the invention.

I claim:

1. A method for supporting at deeper layers of sea bed soil a floating structure which is submerged down onto the sea bed and founded, the structure comprising a caisson having at least one ballast cell and a plurality of skirts extending downwardly below the base of said caisson and defining compartments, said compartments being open at their lower ends, said method comprising the steps of:

floating said structure to a location at sea;

sinking said structure at said location;

introducing sufficient ballast into said ballast cell to cause the skirts to penetrate downwardly into said deeper layers of sea bed soil whereby said skirts form closed compartments each being defined by the skirt, the base of said caisson, and the sea bed;

removing sea water trapped within said closed compartments; and removing ballast from said ballast cell to reduce the vertical load on the sea bed to a load level which the material making up the sea bed can bear without failing whereby movement of said structure is primarily restrained by adherence and friction between the sea bed and said skirts and by temporary pressure differentials within said closed compartments created by partial movement of said structure.

2. A method according to claim 1 wherein the amount of ballast removed from said cell is sufficient to reduce the load of said structure on the sea bed substantially to zero.

* * * * *